US011350660B2

(12) United States Patent
Zappoli et al.

(10) Patent No.: US 11,350,660 B2
(45) Date of Patent: Jun. 7, 2022

(54) METHOD AND APPARATUS FOR MANUFACTURING A CRIMPED SHEET OF MATERIAL

(71) Applicant: PHILIP MORRIS PRODUCTS S.A., Neuchatel (CH)

(72) Inventors: Stefano Zappoli, Bologna (IT); Pietro Davide La Porta, Bologna (IT); Alberto Monzoni, Bologna (IT); Stefano Malossi, Bologna (IT); Antonella Giannini, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 406 days.

(21) Appl. No.: 16/607,388

(22) PCT Filed: Apr. 20, 2018

(86) PCT No.: PCT/EP2018/060162

§ 371 (c)(1),
(2) Date: Oct. 23, 2019

(87) PCT Pub. No.: WO2018/197353

PCT Pub. Date: Nov. 1, 2018

(65) Prior Publication Data

US 2020/0046015 A1 Feb. 13, 2020

(30) Foreign Application Priority Data

Apr. 28, 2017 (EP) ..... 17168822

(51) Int. Cl.
*A24B 3/14* (2006.01)
*A24D 3/02* (2006.01)
(Continued)

(52) U.S. Cl.
CPC ..... *A24B 3/14* (2013.01); *A24D 3/0204* (2013.01); *A24C 5/1828* (2013.01); *D02G 1/12* (2013.01); *E04B 2001/7683* (2013.01)

(58) Field of Classification Search
None
See application file for complete search history.

(56) References Cited

U.S. PATENT DOCUMENTS 3,287,784 A 11/1966 Loftin
5,733,234 A 3/1998 Greiner

FOREIGN PATENT DOCUMENTS

EP 2666624 A1 * 11/2013 ..... A24C 5/005
WO WO 2016/023965 2/2016

OTHER PUBLICATIONS

English translation of EP 2666624A1 (Year: 2016).*
PCT Search Report and Written Opinion for PCT/EP2018/060162 dated Jun. 28, 2018 (11 pages).

* cited by examiner

*Primary Examiner* — Michael J Felton
*Assistant Examiner* — Katherine A Will
(74) *Attorney, Agent, or Firm* — Mueting Raasch Group

(57) ABSTRACT

The present invention relates to an apparatus (100) for crimping a sheet of material (6), the apparatus comprising: a first (9) and a second (10) facing crimping rollers defining a first (1) and a second (22) rotational axis, respectively, the first and second axis being parallel to each other, wherein at least one of the first and second crimping roller includes a plurality of corrugations; an angle changing device, the angle changing device being adapted to change a crimping angle (11) formed between a fixed reference plane (12) and a movable plane (13) containing the first and the second rotational axis.

13 Claims, 2 Drawing Sheets

Figure 1A:
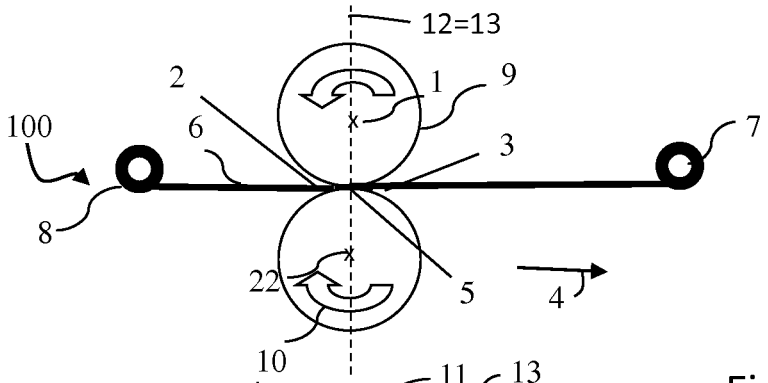

(51) Int. Cl.

| | |
|---|---|
| *A24C 5/18* | (2006.01) |
| *D02G 1/12* | (2006.01) |
| *E04B 1/76* | (2006.01) |

METHOD AND APPARATUS FOR MANUFACTURING A CRIMPED SHEET OF MATERIAL

This application is a U.S. National Stage Application of International Application No. PCT/EP2018/060162 filed Apr. 20, 2018, which was published in English on Nov. 1, 2018 as International Publication No. WO 2018/197353 A1. International Application No. PCT/EP2018/060162 claims priority to European Application No. 17168822.9 filed Apr. 28, 2017.

The invention concerns an apparatus for crimping a sheet of material, a method for crimping a sheet of material, and a method of manufacturing an aerosol-generating article compound.

Typically, aerosol-generating articles comprise a plurality of elements assembled in the form of a rod. The plurality of elements generally includes an aerosol-forming substrate and a filter element. One or both of the filter and the aerosol-forming substrate may comprise a plurality of channels to provide air-flow through the rod. The plurality of channels may be provided by crimping a sheet of material and consequently gathering the material within the rod to form the channels. In such examples, the crimped sheet is generally formed by crimping a substantially continuous web and cutting a plurality of crimped sheets from the crimped and gathered web.

This material to be crimped, that is the continuous web, in the field of aerosol generating articles, can be tobacco cast leaves (TCL), polyactic acid (PLA), tow or others.

Methods of manufacturing a crimped web generally involve feeding a substantially continuous web between a pair of interleaved rollers (which are forming a so-called "nip") to apply a plurality of longitudinally extending crimp corrugations to the continuous web. The crimped web is subsequently gathered to form a continuous rod having a plurality of axial channels. The rod is then wrapped and cut into smaller segments to form an aerosol-generating substrate or filter for an aerosol generating article.

The crimping process creates various effects to the material which is pressed between the crimping rollers.

A first range of effects is related to the manufacturing processes, such as for example the fact that a crimped material can be easily compressed into a rod that will then fit into the aerosol-generating articles.

Once the crimped material is compressed into a rod and added to the aerosol-generating article, a second range of effects is related to the crimping, such as the users' experience. More specifically, the crimping process affects the air contact between the air, penetrating the aerosol-generating article, and the crimped sheet of material, and the resistance to draw (RTD).

The crimping process is therefore very important for a correct manufacturing of the aerosol generating article and for obtaining the desired user experience.

However, a non-optimal or sub-optimal crimping process could weaken the crimped web of material, could deteriorate the release of substances from the crimped sheet of material to the penetrating air of the rod, as well as adversely affect the resistance to draw value.

A problem in this context is that the sheet of material that has to be crimped may show a certain resilience, so that the pattern that is imprinted onto the sheet of material, may fade after a certain time and to a certain extent. This behaviour of the crimped sheet of material may be addressed by varying the time that sheet of material is processed. However, this may have an adverse effect on the production speed. Certainly, a slowdown of the processing speed is not really desired, because it lowers the productivity.

It would be desirable to provide a method and an apparatus for manufacturing a crimped sheet of material, preferably for an aerosol-generating article, that allows to have a better control and an increased flexibility on the aerosol-generating articles' properties which are related to the crimping process.

According to a first aspect of the present invention, an apparatus for crimping a sheet of material is suggested, the apparatus comprising: a first and a second facing crimping rollers defining a first and a second rotational axis, respectively, the first and second axis being parallel to each other, wherein at least one of the first and second crimping roller includes a plurality of corrugations; an angle changing device, the angle changing device being adapted to change a crimping angle formed between a fixed reference plane and a movable plane containing the first and the second rotational axis.

Ultimately, the experience that is noticed by the final consumer, may be determined by the properties of the sheet of material that is contained in the end product. In particular, the size of the corrugations (for example pitch length, amplitude of the corrugations and so on), the arrangement of the corrugations (as an example: channels may be arranged in parallel to the axis of the rod or may be arranged at a certain angle with respect to the axis of the rod), and geometrical characteristics of the corrugations (for example a sine-wave pattern or a rectangular arrangement of the corrugations may be present) may have a major effect on the smoking experience by the end consumer, in particular, but not necessarily limited to the RTD, the content of volatile compounds in the aerosol that will be inhaled, and the like. However, the same apparatus or method may have different crimping results on sheet made of different material. The resilience of the sheet of material that has to be crimped may affect the crimping process and the end results, that is, how the corrugations are formed on the sheet. According to the invention, the characteristics of the material forming the sheet can be taken into account during the crimping varying the angle of crimping so that the "crimping effect" on the sheet may be varied.

As used herein, the term "sheet" denotes a laminar element having a width and length that is substantially greater than the thickness thereof.

As used herein, the term "crimping angle" denotes the angle that is formed between a fixed reference plane and a movable plane containing the first and second rotational axis. The fixed reference plane may be defined with respect to a certain defined position of the arrangement of crimping rollers. In particular, a plane that lies horizontal or vertical may be envisaged for this. A plane that is arranged at a certain angle to the vertical or horizontal direction may be used as well. For example, a plane that is tilted by 10°, 20°, 30°, 33.3°, 40°, 45°, 50°, 60°, 66.7°, 70°, 80° 90° with respect to the horizontal or vertical axis may be used as well as the fixed reference plane. This reference plane is "fixed", that is, once selected it remains in the selected position regardless of the operations of the apparatus where it is defined. Therefore, regardless of movements of the various elements of the apparatus, the fixed reference plane remains "fixed". The movable plane indeed "moves" depending on the movement of the apparatus. This plane connects the two rotational axes of the two crimper rollers, thus if the position of the axes changes, also the position of the plane changes. The movable plane contains both axes, that is, both the first and the second rotational axes. Thus the relative orientation between the first and second rotational axes preferably remains always the same, otherwise one of the two axes would not be included in the same movable plane. The angle between the fixed reference plane and the movable plane is thus variable. The respective angle may be arranged in a clockwise or a counter-clockwise direction. The crimping angle is defined as the angle between the fixed reference plane and the movable plane. In particular, the given orientations of the respective planes (the fixed reference plane or the movable plane) may relate to a situation where the apparatus is arranged in a way (in particular with respect to an angular orientation relative to earth's surface) that it can be operated in the standard operating mode.

As used herein, the term "movable plane" usually relates to a variation with respect to the angular orientation of the respective plane. However, a translational movement of the respective plane may be envisaged additionally or alternatively as well.

As used herein, the terms "the movable plane containing the first and the second rotational axis" may include that the respective first and second axes lie within the movable plane.

As used herein, the term "crimped" denotes a sheet or web with a plurality of corrugations. The term "crimping" denotes the formation of a crimped sheet of material, preferably from an essentially flat sheet of material or a previously untreated sheet of material with respect to generating a structured surface.

As used herein, the term "corrugations" denotes a plurality of substantially parallel ridges formed from alternating peaks and troughs joined by corrugation flanks. This includes, but is not limited to, corrugations having a rhomboid-like profile, a sinusoidal wave profile, a triangular profile, a sawtooth profile, or any combination thereof.

As used herein, the definitions with respect to the dimensions and shapes of the ridges, amplitudes, pitches, tips, flanks and the like may be understood with respect to the resulting crimped sheet of material. However, alternatively, they may (in part) be understood with respect to the rollers of the crimping apparatus or the crimping apparatus itself, as well. In particular, the "crimping angle" as used herein may be preferably used with respect to the rollers or the crimping apparatus of the crimping apparatus itself.

As used herein, the notion "includes a plurality of corrugations" means that at least a section of the respective roller comprises a plurality of corrugations.

As used herein, the notion "section" defines a certain area on the outer circumferential area of the respective roller, where the area may be limited with respect to an extent of the respective area along the rotation axis of the respective roller, with respect to an extent in a circumferential direction along the outer circumferential surface of the respective roller, or both.

As used herein, the term "substantially interleave" denotes that the corrugations of the first and second rollers at least partially mesh. This includes arrangements in which the corrugations of one or both of the rollers are symmetrical or asymmetrical. The corrugations of the rollers may be substantially aligned, or at least partially offset. The peak of one or more corrugations of the first or second rollers may interleave with the trough of a single corrugation of the other of the first and second rollers. Preferably, the corrugations of the first and second rollers interleave such that substantially all of the corrugation troughs of one of the first and second rollers each receive a single corrugation peak of the other of the first and second rollers.

As used herein, the term "longitudinal direction" refers to a direction extending along, or parallel to, the length of a web or sheet.

As used herein, the term "rotation axis" or "rotational axis" refers to a direction extending along, or parallel to, a line that does essentially show no translational movement when the respective roller is rotated during its normal state of operation. This may be referred as to the axis of the respective roller.

As used herein, the term "width" refers to a direction perpendicular to the length of a web or sheet, or in the case of a roller, parallel to the axis of the roller.

As used herein, the term "rod" denotes a generally cylindrical element of substantially circular or oval cross-section.

As used herein, the terms "axial" or "axially" refer to a direction extending along, or parallel to, the cylindrical axis of a rod.

As used herein, the terms "gathered" or "gathering" denote that a web or sheet is convoluted, or otherwise compressed or constricted substantially transversely to the cylindrical axis of the rod.

As used herein, the terms "horizontal" and "vertical" have their standard meaning. Preferably, the apparatus of the invention is oriented so that the first and second rotational axis of the crimping rollers are horizontal, that is, they are parallel to a horizontal plane.

In order to produce a crimped sheet of material, the sheet of material, which can be for example tow, PLA or a sheet formed by homogenized tobacco material, is transported along a transport direction. The transport can be performed by any suitable means, for example by pulling via rollers, in particular by pulling using said first and second crimping roller. During the transport, the sheet or web of material may pass through a so-called "nip" that is formed between a first and a second crimping roller.

At least one of the rollers, either the first or the second roller or both includes corrugations, preferably ridges, which come into contact with the sheet of material so that corresponding corrugations are formed on the sheet when it passes through the nip.

Both the first and the second crimping rollers may show a plurality of ridges or corrugations. In particular in this case, the rollers may be designed an arranged in a way that at least parts of them do substantially interleave.

One of the first and second rollers may show corrugations, the other roller showing an essentially smooth cylindrical surface.

Both the first and second rollers may show corrugations in non-corresponding sections. That is for each portion of the sheet of material which comes into contact with the rollers, only one of the first and second roller forms crimp corrugations on that portion of the sheet of material. The sheet of material may be processed by the rollers substantially in three steps of crimping. A "pre" step, where the sheet is pulled between the crimping rollers, for example by a first rotating crimper roller. In this pre step, the sheet comes into contact with a surface of the first roller, at least in part. In the contact area between the sheet and the first roller, there is an initial pressure of the ridges of the roller onto the sheet. After the pre step, the sheet is compressed between the two crimper rollers, to form the corrugations onto the sheet. A "post" step is also present: the sheet exits the area where it has been pressed between the two crimper rollers and runs along the second rotating crimper roller for a given length, so that there is again a contact area between the ridges of the second roller and the crimped sheet.

In the "pre" and "post" steps, the corrugations of the rollers work only on one side of the sheet.

By preparing the sheet in the "pre" step and reinforcing the pressing which took place between the two rollers in the "post" step, it creates the crimping on the material.

The shorter the time duration of the overall crimping process, the stronger and more brutal the crimping is.

A strong crimping increases the chance of damaging an inelastic and fragile material as can be the TCL (Tobacco Cast Leaf) material, while it could be needed to treat properly more elastic and adaptive material which otherwise will not be adequately crimped. Furthermore, even for a similar material, there could be different production batch with slightly different characteristics which will need adapted crimping strength.

The time duration of the crimping is depending on the time of each of the indicated crimping steps.

Because the sheet speed is usually "production fixed", for example between about 200 meters per minute and about 400 meters per minute, the time duration of the crimping is depending on time in which the sheet remains into contact with the corrugations of the rollers. In particular, the contact areas between the sheet and the rollers in the "pre" and "post" steps are related to the positions of the crimper rollers, while the contact area in the "in-between" step (that is—in the nip) is related to the distance between the rollers, which is also related to the thickness of the foil.

Adjusting the relative position formed between the two rollers, that is, adjusting the crimping angle, the time of contact and the lenght of contact between the sheet and the rollers, that is, the length of the sheet which is in contact with one of the rollers, can be varied. Indeed, changing such a crimping angle, changes the length of the sheet along the longitudinal direction that is in contact with the first and second roller in the pre and post crimping step.

Changing the crimping angle may also change the length of contact between sheet and rollers. In other words, there is a contact between the sheet and the rollers which involves a certain area of the sheet. This area has an extension that depends on the crimping angle. The contact area can be defined by a width, equal to the width of the sheet, and a length. Due to the fact that the width of the sheet is substantially constant, in order to change the contact area, only the length of the contact area can be changed. Therefore the contact area depends on the "length" of contact between the crimping roller and the sheet. At a first crimping angle for example, the distance or length of contact may be below about 40 millimeters or below about 20 millimeters. At a second crimping angle, the distance or length of contact may be at least about 50 millimeters or at least about 100 millimeters. The length of contact can vary between a first and a second crimping angle and the difference between the first length and the second length can be of at least about 10 millimeters, or at least about 20 millimeters, or at least about 50 millimeters, or at least about 100 millimeters, or at least about 400 millimeters.

The crimping angle is defined as an angle between a fixed reference plane, which can be any fixed plane, and a second plane which contains both first and second rotational axes of the first and second rollers, called movable plane. This second or movable plane is movable if the first or second axis changes its position with respect to the fixed plane.

In a very simple manner, therefore, the crimping time can be varied, simply changing an angle between two rollers. This in turn means that the length of contact can be varied as well. The apparatus of the invention can be therefore adapted to the material forming the sheet to be crimped.

Preferably, the first rotational axis is parallel to the second rotational axis. More preferably, the first rotational axis remains parallel to the second rotational axis also during the change of the crimping angle. Preferably, the angle changing device is adapted to change a crimping angle formed between the fixed reference plane and the movable plane keeping the relative orientation of the first and the second rotational axis unchanged. More preferably, the angle changing device is adapted to keep of the first and the second rotational axis parallel to each other.

Preferably, the fixed reference plane is a horizontal or vertical plane. The wording of "horizontal" may relate to an at least essentially parallel plane defined by the main chassis of the apparatus for crimping a sheet of material, the crimping rollers are used in (wherein the respective plane, defined by the main chassis resembles at least somewhat a horizontal plane with respect to earth's surface), or preferably to a plane that is parallel to a plane that is horizontal with respect to earth's surface. Alternatively, a vertical plane is a plane substantially perpendicular to the above defined horizontal plane. Both definitions may relate to an intended alignment of the apparatus, in which the apparatus is to intended to be operated on a normal base. Using the proposed definition, a particularly clearly defined reference plane may be provided as a reference.

Further preferred, the apparatus is designed in a way that the angle changing device is adapted to rotate the second roller around the first rotational axis of the first roller so as to change the crimping angle. Alternatively, the apparatus is designed in a way that the angle changing device is adapted to rotate the first roller around the second rotational axis of the second roller so as to change the crimping angle. This "rotation" may both include a rotation along a part of a circle line in a more or less stringent mathematical way, but also a rotation along a bent line that is more or less profoundly deviating from a circular line in the mathematical sense. In both of the aforementioned cases (and possibly in other cases as well), the rotation may be performed in a way that the distance between the first and the second roller remains essentially constant, meaning in turn that the width of the nip remains essentially constant. However, the rotation may be as well such that the width of the nip changes. It may be that not only the second roller is performing a rotating movement, but also the first roller is performing a rotating movement. As a centre of rotation, one may use the rotational axis of the respective other roller or a line that is representative of the nip. Preferably, this line runs parallel to the rotational axis of the first and second roller and follows a line that is equal to a series of points where the distance to the outer circumferential surfaces of both the first and second roller is minimal. Using such a design, the variation of the crimping angle may be realised particularly simple and reliably.

However, changing the crimping angle may involve the movement of both the first and second crimping roller, that is, a movement of both the first and second rotational axis. Due to the fact that the movable plane contains both the first and the second rotational axes, the relative positioning of the first and second roller has some constraints, however they can both be rotated or shifted with respect to the fixed plane. For example, the first and second roller can both rotate around an axis lying on the movable plane and positioned between the first and second rotational axis.

Preferably, the fixed plane passes through the first or second rotational axis. As used herein, the terms "plane passing through an axis" may include that the respective axis lies within the plane.

Further preferred the apparatus is designed in a way that the first and the second rollers are adapted to be rotated around the first and second rotational axis, respectively, by means of a first and a second motor. This way, a good transportation behaviour of the material to be crimped may be realised. In particular, the sheet of material may essentially be moved by a pulling force of the first and second roller. By providing both the first and second roller with a separate motors, possible shear forces on the sheet of material to be crimped may be advantageously minimised or even avoided, which may result in a lower tendency for any shredding behaviour or otherwise adverse effect on the sheet of material to be crimped.

Preferably, the apparatus is designed in a way that it includes a wheel that is rotatable around the first rotational axis, the first and second roller being attached to the wheel so that a rotation of the wheel determines a rotation of the second roller around the first roller changing the crimping angle. Using this design possibility, a type of rotation in which the distance between the first and second roller remains essentially constant (resulting in an essentially constant width of the nip) can be realised in a particularly simple way. Furthermore, both a very fine tuning, necessitating only small forces or torques can be realised by using a worm gear type driving mechanism for said wheel. In particular, both an automated adjustment (using a motor, a servo or the like) or a manual adjustment may be possible.

Further preferred, the apparatus is designed in a way that it includes a distance changing device adapted to change a distance between the first and the second roller. Such a design may prove to be particularly advantageous, because another of the influencing factors that influence the shape of the final crimped sheet of material—taking resilience and other effects into account—can be advantageously and easily changed. This way, a particularly well adapted and "fine tuned" sheet of material may be realised, where the influencing parameters may usually be changed in a particularly broad range.

Further preferred, the distance changing device includes an arm on which the first or second roller is attached to and a pivot point, and wherein the distance changing device is adapted to rotate the arm around the pivot point so that the distance between the first and second roller can be changed. Using this suggestion, the mechanical realisation for changing the distance between the first and second roller may be particularly simple to achieve. In particular, it is possible to use arms of different lengths, so that by employing a lever action, a particularly fine tuning, a particularly low actuation force, or both can be easily realised. In particular, it is possible to arrange the pivot point on the above referenced wheel as well, so that the mechanical realisation of the apparatus may be particularly simple.

According to a second aspect of the invention, a method for crimping a sheet of material is suggested, wherein the method includes: feeding a substantially continuous sheet of material to a set of crimping rollers, the set of rollers comprising a first roller and a second roller defining a first and a second rotational axis, respectively, at least one of the first or second roller including a plurality of corrugations; selecting a crimping angle formed between a fixed reference plane and a movable plane containing the first and the second rotational axis; and crimping the substantially continuous sheet to form the crimped sheet by feeding the substantially continuous sheet between the first and second rollers in a longitudinal direction of the substantially continuous sheet such that the corrugations of the first or second rollers apply a plurality of crimp corrugations to the substantially continuous sheet of material.

Advantages of the second aspect of the invention have been already set forth in relation with the first aspect and are not repeated herewith.

The actual value of the crimping angle that is formed between the fixed reference plane and the movable plane may be chosen in a way that the crimped sheet of material with the desired output characteristics may be obtained. The determination of suitable parameters may be done by an initial calibration run, in particular if a new batch of raw material with yet unknown characteristics has to be crimped. The thus determined settings for the apparatus may be used until a new batch of raw material arrives. Nevertheless it is possible that a continuous or intermittent measurement of the crimped sheet of material is performed and the settings of the apparatus are modified, if deemed to be appropriate or necessary. Furthermore, certain initial parameter settings may be stored in a lookup table so that they can be used as initial parameters (that may be modified during production) if a new batch of material with more or less known characteristics are employed. When using a method according to the present invention, it is possible that characteristics and advantages may be obtained that are at least similar to the characteristics and advantages of the previously described apparatus. Furthermore, it is possible that the method may be modified in a way as previously described in the context of an apparatus for crimping a sheet of material, at least in analogy. The thus modified method may show the same characteristics and advantages as previously described in the respective context, at least in analogy.

According to a third aspect of the invention, a method of manufacturing an aerosol-generating article component is proposed, wherein the method comprises the steps of: manufacturing a crimped sheet according to the previously described second aspect of the invention; gathering the crimped sheet to form a continuous rod; and cutting the continuous rod into a plurality of rod-shaped components, each rod-shaped component having a gathered crimped sheet formed from a cut portion of the crimped sheet, the crimp corrugations of the crimped sheet defining a plurality of channels in the rod-shaped component.

This way, an aerosol-generating article that suits the present-day market needs may be realised in an efficient and cheap way. In particular, an aerosol-generating article may be realised that resembles a traditional combustion-type aerosol-generating product, in particular a traditional cigarette. The "gathering" can particularly involve the previously described gathering methods. In particular, the "gathering" may comprise a folding process where two portions of the crimped sheet of material can be put on top of each other by a folding-type operation along a usually straight line, or a rolling operation, where the initially ungathered, crimped sheet of material is brought into some kind of a coil-like form. Possibly, a combination of folding and rolling processes may be used as well, where usually a folding-type operation is performed prior to a rolling operation.

A crimped sheet of material that was crimped in the above-described sense may be used for an aerosol-generating article comprising a rod formed from a gathered crimped sheet that was produced in the previously described way.

Such an aerosol-generating article may resemble a combustible smoking article, such as a cigarette. An aerosol-generating article may comprise tobacco. An aerosol-generating article may be disposable. An aerosol-generating article may be partially-reusable and comprise a replenishable or replaceable aerosol-forming substrate.

The elements of the aerosol-generating article are preferably assembled by means of a suitable wrapper, for example a cigarette paper. A cigarette paper may be any suitable material for wrapping components of an aerosol-generating article in the form of a rod. Preferably, the cigarette paper holds and aligns the component elements of the aerosol-generating article when the article is assembled and holds them in position within the rod. Suitable materials are well known in the art.

The aerosol-generating article may be substantially cylindrical in shape. The aerosol-generating article may be substantially elongate. The aerosol-generating article may have a length and a circumference substantially perpendicular to the length.

The aerosol-generating article may have a total length between approximately 30 millimetres and approximately about 100 millimeters. The aerosol-generating article may have an external diameter between approximately about 5 millimeters and approximately about 12 millimeters.

The aerosol-generating article may comprise a filter or mouthpiece. The filter may be located at the downstream end of the aerosol-generating article. The filter may be a cellulose acetate filter plug. The filter is approximately about 7 millimeters in length in one embodiment, but may have a length of between approximately about 5 millimeters and approximately about 10 millimeters. The aerosol-generating article may comprise a spacer element located downstream of the aerosol-forming substrate.

Preferably, the sheet of material is one of: a homogenized tobacco sheet, a plastic sheet or a sheet including cellulose. As used herein, the term "homogenised tobacco material" denotes material formed by agglomerating particulate plant material, for example tobacco. Preferably, the plant material contains alkaloids.

The homogenised tobacco material may have an aerosol-former content of greater than about 5 percent on a dry weight basis. The homogenised tobacco material may alternatively have an aerosol former content of between about 5 percent and about 30 percent by weight on a dry weight basis. Sheets of homogenised tobacco material may be formed by agglomerating particulate tobacco or plants obtained by grinding or otherwise comminuting one or both of tobacco leaf lamina and tobacco leaf stems; alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and nonaqueous solvents and combinations thereof.

Examples of suitable aerosol formers are glycerine and propylene glycol.

For such sheets, the presently proposed method may be particularly suited. In particular, any resilience that the respective sheets of material may show may be advantageously dealt with when using the previously described methods or when employing the previously described apparatus.

Preferably, the sheet of material defines a first and a second surface, and wherein the method includes the step of changing a length in the longitudinal direction of a portion of the first or second surface in contact with the first or the second roller. Changing the angle between the fixed reference plane and the movable plane may change also the length of the sheet which is in contact to the crimping rollers and therefore the crimping time changes. This can be realized on one surface of the sheet, or in both surfaces of the sheet.

An area of a portion of the first surface of the sheet in contact with the first roller or the second roller may vary in size changing the crimping angle. In the same way, an area of a portion of the second surface of the sheet in contact with the first roller or the second roller may vary in size changing the crimping angle. This way, the length of time the sheet of material is in contact with at least one of the first or second roller may be varied even significantly, even when the processing speed (movement of the sheet of material to be crimped in a lengthwise direction per unit time) remains at least essentially constant. This allows to set a different pre or post processing time in a very easy manner. Thus, the parameters of the finished sheet of material may be set in a broad and advantageous way, despite of any resilience properties of the sheet of material to be crimped. Therefore, a superior aerosol-generating rod-shaped component for an aerosol-generating article may be realised.

More preferably, the method includes the step of changing a length in the longitudinal direction of a portion of the first surface in contact with the first roller and a length in the longitudinal direction of a portion of the second surface in contact with the second roller at the same time. This way, a single adapting movement may result in a particularly profound change of the properties of the crimped sheet of material that was processed by the respective apparatus. Furthermore, a particularly broad range in change of a contact surface between the first roller and the second roller on one hand and the sheet of material to be crimped on the other hand may be realised. This way, a particularly broad change in material characteristics of the sheet of material to be treated may be realised.

Preferably, the method includes the step of rotating the first crimping roller around the second rotational axis of the second crimping roller. That is, the first roller rotates around its own rotational axis and also performes a revolution around the second axis of the second roller. In this case the fixed plane may be a plane passing through the axis of rotation of the second roller and the first roller rotates around the second roller changing the crimping axis. The rotational axis of the second roller is preferably fixed.

Preferably, the method incldes the step of keeping the first rotational axis parallel to the second rotational axis during the step of selecting the crimping angle.

Figure 2A:
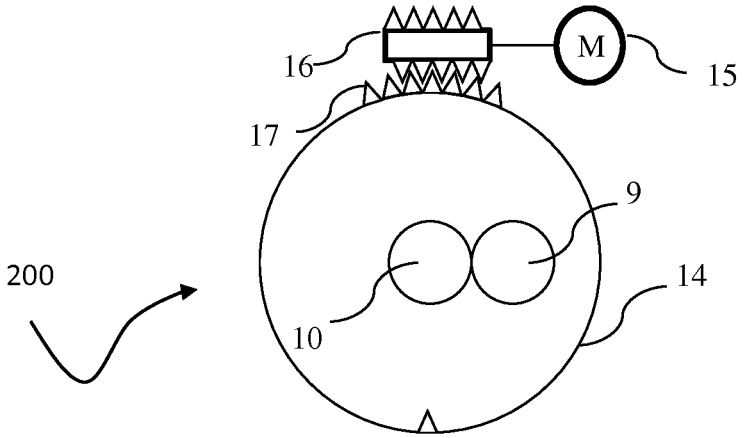
Figure 2B:
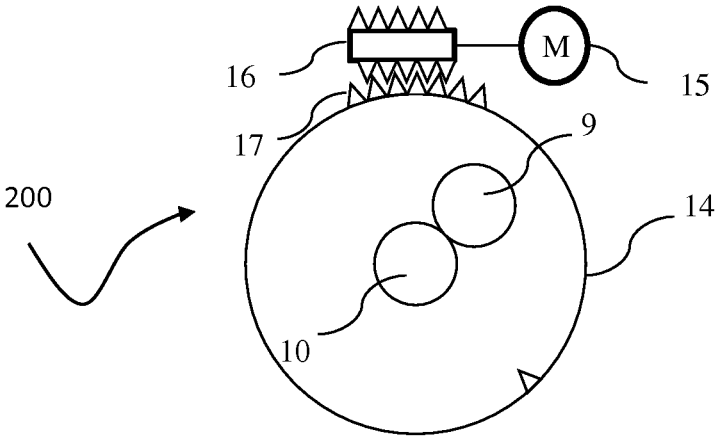
Figure 3:
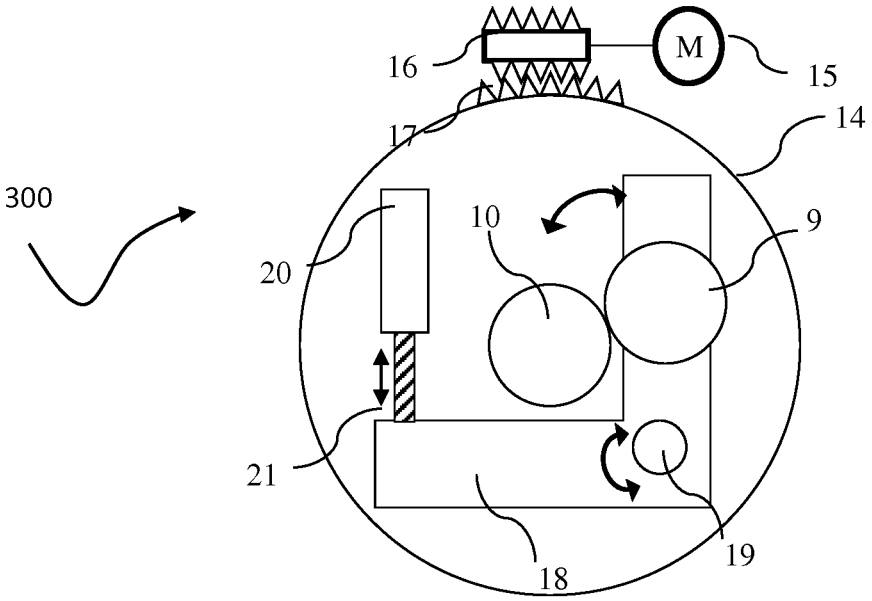

Further advantages of the invention will become apparent from the detailed description thereof with non-limiting reference to the appended drawings:

FIGS. 1*a*-1*d* are schematic lateral views of an apparatus for manufacturing a crimped sheet of material in different positions of the neighbouring first and second crimping rollers;

FIGS. 2*a*-2*b* are schematic lateral views of a first possible embodiment for a driving mechanism for rotating a set of crimping rollers with respect to each other in two different positions; and FIG. 3 is a schematic lateral view of a second possible embodiment for a driving mechanism for rotating a set of crimping rollers with respect to each other, comprising a possible mechanism for varying the distance between the crimping rollers.

In FIGS. 1*a*-1*d*, a schematic lateral view of an apparatus 100 for manufacturing a crimped sheet of material is shown in different positions. The apparatus 100 includes two crimping rollers 9, 10. In particular, different crimping angles 11—as better defined below—are realised by an appropriate positioning of the two opposing crimping rollers 9, 10 with respect to each other, where the crimping angle 11 does not only vary with respect to the magnitude of the angle, but also with respect to the direction of the angle.

The apparatus 100 is adapted to crimp a sheet of material 6 which is supplied by means of a first coil, namely a supply coil 8. The sheet of material defines a transport direction 4 (indicated with an arrow in the figures) towards the crimping rollers 9, 10. With respect to the transport direction, the supply coil is located upstream the rollers. Apparatus 100 further includes a receiving coil 7 located downstream the rollers 9, 10. On the supply coil 8, an "endless" sheet of a flat and thin layer of material 6 to be crimped using the pair of crimping rollers 9, 10 is provided. The layer of material 6 may be a homogenised tobacco sheet including plant material or a plastic sheet or a cellulose-type sheet, on which some type of tobacco-like flavour compound may be applied. It is to be understood that the sheet of material 6 that is wound up on coil 8 is strictly speaking not endless, of course. However, the overall length of the sheet of material 6 can be several hundred metres and is therefore much longer than its width. Furthermore, it is possible that a handover mechanism between two consecutive supply coils 8 (not shown) is provided so that a continuous crimping process will be possible. Of course, this would imply an appropriate handover mechanism for the receiving coil 7 as well (also not shown).

The sheet of material 6 that is coiled down from the supply coil 8 and enters the "main part" of the apparatus 100, where the processing of the sheet of material 6 is performed by means of first and second roller 9, 10.

For processing, the first roller 9, the second roller 10 or both rollers 9, 10 are provided with a surface structure, for example including a plurality of ridges (not visible in the drawings). Preferably, both rollers 9, 10 are provided with a surface structure, where the surface structures are designed in a corresponding way, so that the ridges on the first roller 9 will at least partially interleave into corresponding, neighbouring troughs of the second roller 10 and vice-versa. First and second roller 9, 10 each defines a rotational axis 1, 22 (visible in FIG. 1*a*), named first and second rotational axis, around which they are adapted to rotate. Preferably, rollers 9, 10 are substantially cylindrical and the rotational axis is the axis of the cylinder.

The processing of the layer of material 6 is mainly done in a nip 5 which is formed between the first roller 9 and the second roller 10 by placing the two rollers 9, 10 at a certain distance. The distance between the two rollers 9, 10 may be fixed or may be variable, as detailed below with reference to the embodiment in FIG. 3. The width of the nip 5 is chosen to be roughly in the range of the thickness of the entering sheet of material 6. The width of the nip 5 is usually defined as the smallest distance to a neighbouring surface portion of the other roller 9, 10 in a direction that is essentially perpendicular to the surface portion in question. Depending on the current necessities of the processing process, the width of the nip 5 is typically slightly smaller than the thickness of the entering sheet of material 6 so that the entering sheet of material 6 is slightly compressed in the nip 5. Thus, a traction force can be applied to the flat sheet of material 6 by the rollers 9, 10. For achieving this, the two rollers 9, 10 are driven by a motor (not shown), presently the first roller 9 in a counter-clockwise direction and the second roller 10 in a clockwise direction, so that the sheet of material 6 is transported from the supply coil 8 towards the collecting coil 7.

However, a processing of the sheet of material 6 is not only performed in the nip 5 itself, but also an additional processing is done on a surface section 2 of one of the rollers 9, 10 ahead of the nip 5 (seen the transport direction 4 for of the sheet of material 6), and furthermore preferably also in another surface section 3 after the nip 5 on one of the rollers 9, 10 as well. It is to be noted that this processing is preferably only performed on one side of the sheet of material 6 and is mainly effectuated under the influence of the tension that is imposed on the sheet of material 6. However, by these surface sections 2, 3, a possibly significantly prolonged processing time can be achieved. The surface section 2, 3 are those portions of surfaces of the first and second roller which are in contact with the sheet 6 while the sheet is crimped. Indeed, the extent of this surface, either 2 or 3, can vary depending on the angle 11.

The thus processed sheet of material 6 leaves the processing part of the apparatus as a crimped sheet of material and is wound up on the collection coil 7. The collection coil 7 is preferably actively driven to be able to generate a pulling force, and the supply coil 8 preferably has to be driven as well or at least a (preferably variable) braking force has to be applied to the supply coil 8 so that a sufficient tension on the sheet of material 6 is present.

In the crimping apparatus 100 according to the present invention is possible to vary the sizes, that is, the length, of the surface sections 2, 3 ahead and after the nip 5 by a simple adjustment process, without any need for rebuilding the apparatus. This way, the processing time of the sheet of material 6 to be processed can be varied in a broad range without the necessity to change the processing speed (advancement of the sheet of material 6 in transport direction 4 per unit time; this goes linearly with the rotation speed of the first and second roller 9, 10). This can be achieved by varying the crimping angle 11, as can be seen by comparing the different settings of the crimping apparatus 100 in the different figures FIGS. 1*a*-1*d*. The crimping angle 11 is indicated in the FIGS. 1*a*-1*d* as delimited by two dashed lines.

The crimping angle 11 is defined as the angle between a fixed reference plane, presently a vertical plane 12, and a moving plane 13 that is defined by a plane passing through or containing the two rotational axes 1, 22 of the two rollers 9, 10 in their respective current position. The fixed plane passes through the first rotational axis 1.

As can be seen from FIGS. 1*a*-1*d*, in FIG. 1*a* the vertical plane 12 and the moving plane 13 are parallel to each other so that the crimping angle 11 is 0°. Here, the surface sections 2, 3 ahead and after the nip 5, where a contact between the sheet of material 6 and one of the rollers 9, 10 exists, are minimal in size. It should be noted that by an appropriate placement of the collecting coil 7 and the supply coil 8, these "additional surfaces sections" 2, 3 can be reduced to essentially 0, at least at a certain diameter of the collecting coil 7 and supply coil 8, unless some horizontal movement of the respective coils is foreseen, or additional guiding rollers (presently not shown) are employed. Of course, by arranging the collecting coil 7, the supply coil 8 and possibly additional guiding rollers (if present) appropriately, one can realise surface sections 2, 3 of a significant size as well, even if the crimping angle 11 is set to 0°.

Figure 1B:
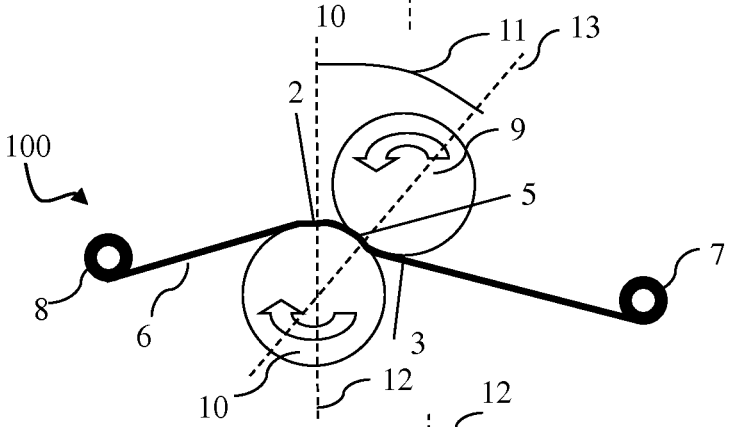

In FIG. 1*b*, the crimping angle 11 is set to 45° in a clockwise direction. Therefore, the lower side of the sheet of material 6 is "pre-treated" (that is prior to the processing done by the nip 5) in surface section 2 ahead of the nip 5 through a contact with the second roller 10. After the nip 5, the already (partially) crimped layer of material is "post-treated" on its upper side through a contact with first roller 9 in surface section 3 after nip 5.

Figure 1C:
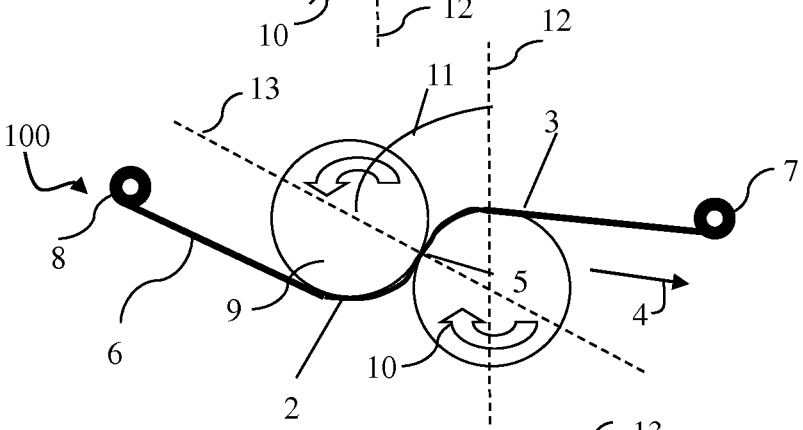

By setting the crimping angle 11 at approximately the same magnitude (that is, circa 45°), but in the opposite direction (counter-clockwise), as it is done in FIG. 1*c*, the "pre-treatment phase" and the "post-treatment phase" of the sheet of material 6 are sort of interchanged. Therefore, in surface section 2 ahead of the nip 5, the upper side of the sheet of material 6 will be pre-treated by a first roller 9, while post-treatment will take place in surface section 3 after the nip 5 by a contact of the lower side of the already (partially) crimped layer of material with second roller 10.

Figure 1D:
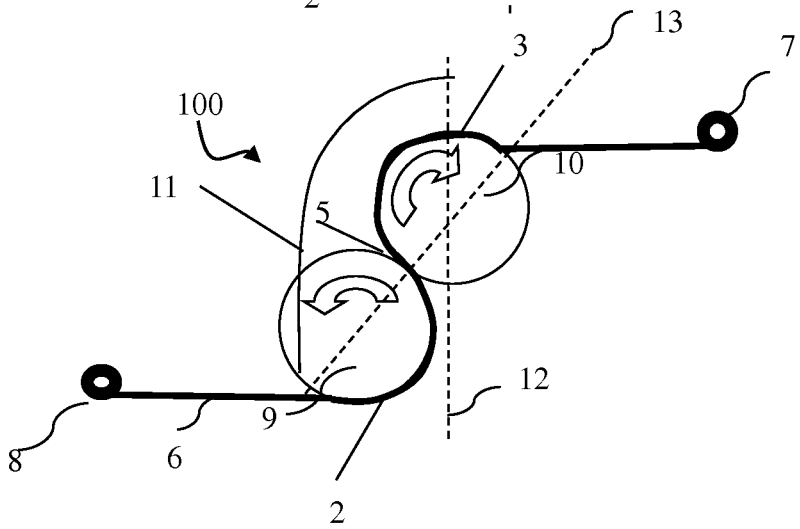

In FIG. 1*d*, the magnitude of the crimping angle 11 is even further increased over the position according to FIG. 1*c*. Now, the crimping angle 11 is 135° in magnitude, in a counter-clockwise direction. As can be seen from FIG. 1*d*, the size of the surface section 2, 3, and therefore the duration of the pre-treatment phase as well as the duration of the post-treatment phase is significantly increased. It is noted again that this significant increase of the pre-treatment time and the post-treatment time does not necessitate a change in processing speed of the sheet of material 6, that is the movement of the sheet of material 6 in transport direction 4 per unit time. Instead, this can be done by setting the crimping angle 11 to an appropriate angle (not only the four discreet angles according to the FIGS. 1*a*-1*d*, but also an indefinite number of other angles).

As clear from the figures, the first roller 9 substantially "rotates" around the second roller 10.

In FIGS. 2*a*-2*b*, an embodiment of an apparatus 200 for realising an arrangement of two rollers 9, 10 that show a variable crimping angle 11 is shown a schematic lateral view.

The rollers 9, 10 are rotatably attached to a couple of plates 14 (one on each end of rollers 9, 10), where in FIGS. 2*a*-2*b* only one of those plates 14 is shown. The plates 14 can be rotated using a stepper motor 15, where the stepper motor 15 is driving an external screw thread 16 that combs into a corresponding arrangement of teeth 17, which are arranged along the outer circumferential surfaces of plates 14 (in FIGS. 2*a*-2*b* only part of the teeth 17 are shown).

When rotating the external screw thread 16, different angular positions of the plates 14 and thus different crimping angles 11 can be easily realised. For brevity, only two distinct positions of plates 14 and therefore of crimping angles 11 are shown in comparison. Namely, in FIG. 2*a* crimping angle 11 is set to 0° (both the reference plane 12 and the movable plane 13 are horizontal; compare to FIG. 1*a*), while in FIG. 2*b* the crimping angle 11 is set to 45°.

Only for completeness, it should be mentioned that instead of a stepper motor 15 different actuation means can be employed as well. It is not only possible to use an "automated means", but also a hand crank or the like may be used as well.

In FIG. 3, a lateral side view of an additional embodiment of an apparatus 300 including a mechanical arrangement of two rollers 9, 10 is shown, where the distance between the two rollers 9, 10 can be varied in an easy way, so that the width of the nip 5 can be adapted for varying sheets of material 6 to be crimped by the apparatus.

The presently shown embodiment of the apparatus 300 is similar to the apparatus 200 of the embodiment that is shown in FIGS. 2*a*-2*b* in that a pair of plates 14 that can be rotated by means of a worm gear type actuator 16, 17 is employed.

The second roller 10 is "directly" attached to the plate 14 in a rotatable away.

For being able to vary the distance between the first and the second roller 9, 10, the first roller 9 is rotatably arranged on a first leg of an L-shaped lever 18. The lever is rotatably attached to the plates 14 by means of a pivot point 19. While the first roller 9 is arranged on a first leg of the lever 18, the second leg of the lever is attached to an actuator 20 via a driving rod 21 that can be driven back and forth by the actuator 20. This back-and-forth movement of the actuator rod 21 (initiated by actuator 20) is translated through the pivoting movement of lever 18 around pivot point 19 into a variation of the distance between the first and second roller 9, 10 and thus into a variation of the width of nip 5.

It is to be noted that the embodiments shown are presently given for illustrative purposes and are not meant to be limiting the scope of the invention in any case. In particular, it is also possible to combine certain features of the certain embodiments given in a way that is obvious to a person skilled in the art.

The invention claimed is:

1. Apparatus for crimping a sheet of material, the apparatus comprising:

a first and a second facing crimping rollers defining a first and a second rotational axis, respectively, the first and second axis being parallel to each other, wherein at least one of the first and second crimping roller includes a plurality of corrugations;

an angle changing device, the angle changing device being adapted to change a crimping angle formed between a fixed reference plane and a movable plane containing the first and the second rotational axis.

2. The apparatus according to claim 1, wherein the fixed reference plane is a horizontal or a vertical plane.

3. The apparatus according to claim 1, wherein the angle changing device is adapted to rotate the first roller around the second rotational axis of the second roller so as to change the crimping angle.

4. The apparatus according to claim 1, wherein the first and the second rollers are adapted to be rotated around the first and second rotational axis, respectively, by means of a first and a second motor.

5. The apparatus according to claim 1, including a wheel rotatable around the first rotational axis, the first and second roller being attached to the wheel so that a rotation of the wheel determines a rotation of the second roller around the first roller changing the crimping angle.

6. The apparatus according to claim 1, including a distance changing device adapted to change a distance between the first and the second roller.

7. The apparatus according to claim 6, wherein the distance changing device includes an arm on which the first or second roller is attached to and a pivot point, and wherein the distance changing device is adapted to rotate the arm around the pivot point so that the distance between the first and second roller can be changed.

8. A method for crimping a sheet of material, wherein the method includes:

feeding a substantially continuous sheet of material to a set of crimping rollers, the set of rollers comprising a first roller and a second roller defining a first and a second rotational axis, respectively, at least one of the first or second roller including a plurality of corrugations;

selecting a crimping angle formed between a fixed reference plane and a movable plane containing the first and the second rotational axis; and crimping the substantially continuous sheet to form the crimped sheet by feeding the substantially continuous sheet between the first and second rollers in a longitudinal direction of the substantially continuous sheet such that the corrugations of the first or second rollers apply a plurality of crimp corrugations to the substantially continuous sheet of material.

9. A method of manufacturing an aerosol-generating article component, the method comprising the steps of:

manufacturing a crimped sheet according to claim 8;

gathering the crimped sheet to form a continuous rod; and cutting the continuous rod into a plurality of rod-shaped components, each rod-shaped component having a gathered crimped sheet formed from a cut portion of the crimped sheet, the crimp corrugations of the crimped sheet defining a plurality of channels in the rod-shaped component.

10. The method according to claim 8, wherein the sheet of material is one of: a homogenized tobacco sheet, a plastic sheet or a sheet including cellulose.

11. The method according to claim 8, wherein the sheet of material defines a first and a second surface, and wherein the method includes the step of changing a length in the longitudinal direction of a portion of the first or second surface in contact with the first or the second roller.

12. The method according to claim 11, including the step of changing a length in the longitudinal direction of a portion of the first surface in contact with the first roller and a length in the longitudinal direction of a portion of the second surface in contact with the second roller at the same time.

13. The method according to claim 8, including the step of rotating the first crimping roller around the second rotational axis of the second crimping roller.

* * * * *